US012352511B2

(12) United States Patent
Bossick et al.

(10) Patent No.: US 12,352,511 B2
(45) Date of Patent: Jul. 8, 2025

(54) TELESCOPING COVER FOR A THREADED ROD

(71) Applicant: SPX Flow, Inc., Charlotte, NC (US)

(72) Inventors: John Bossick, Charlotte, NC (US); Neil Jarman, Charlotte, NC (US); Pete Matkovics, Charlotte, NC (US)

(73) Assignee: SPX Flow, Inc., Charlotte, NC (US)

( * ) Notice: Subject to any disclaimer, the term of this patent is extended or adjusted under 35 U.S.C. 154(b) by 228 days.

(21) Appl. No.: 17/959,717

(22) Filed: Oct. 4, 2022

(65) Prior Publication Data

US 2024/0110754 A1 Apr. 4, 2024

(51) Int. Cl.
*F28F 9/00* (2006.01)
*F28F 9/007* (2006.01)
*F28F 9/26* (2006.01)

(52) U.S. Cl.
CPC ..... *F28F 9/007* (2013.01); *F28F 9/26* (2013.01)

(58) Field of Classification Search
CPC .. F28F 9/007; F28F 9/0075; F28F 9/26; F28F 3/083; F28F 2275/205; F28F 9/0132; F28F 9/0133; F28D 9/005
See application file for complete search history.

(56) References Cited

U.S. PATENT DOCUMENTS 2,639,126 A * 5/1953 Newhall ..... B30B 9/10 210/230
5,462,112 A * 10/1995 Johansson ..... F28F 3/083 165/167
8,540,013 B1 * 9/2013 Sanders ..... A23L 3/001 403/348
9,046,310 B2 * 6/2015 Joensen ..... F28F 3/086
2004/0188060 A1 * 9/2004 Finch ..... F28F 9/0075 165/167
2009/0095457 A1 * 4/2009 Nyander ..... F28F 3/083 165/167

FOREIGN PATENT DOCUMENTS

GB 1271330 A * 4/1972
GB 2274509 A * 7/1994 ..... F28F 3/083
JP 2008018617 A * 1/2008

* cited by examiner

*Primary Examiner* — Tho V Duong
(74) *Attorney, Agent, or Firm* — IceMiller LLP

(57) ABSTRACT

A plate heat exchanger includes a head, a housing, a frame, a pack, a follower, and a first tie bar. The housing has a driving mechanism. The frame is disposed between the head and housing. The pack includes a plurality of heat exchange plates. The follower is configured to slide along the frame and compress the pack between the follower and the head. The follower has a nut with internal threads. The first tie bar is disposed between the head and the housing. The first tie bar has external threads configured to mate with the internal threads of the nut. The driving mechanism is configured to rotate the first tie bar and the follower is configured to translate along the first tie bar in response to rotation of the first tie bar. A first telescoping cover is disposed between the head and the follower. The first telescoping cover is configured to cover the first tie bar and control the ingress and egress of fluid coming into contact with the first tie bar disposed within the first telescoping cover.

12 Claims, 3 Drawing Sheets

TELESCOPING COVER FOR A THREADED ROD

FIELD OF THE INVENTION

The present invention relates to a cover for a threaded rod on a plate heat exchanger of the kind having a package of heat transfer plates clamped together between two end covers and, more particularly, to a telescoping cover for the threaded rod to improve the process for cleaning the plate heat exchanger.

BACKGROUND OF THE INVENTION

In certain industries, heat exchangers are required to be opened weekly or daily to inspect the heat transfer plates. This process can require the removal of one or more plates for closer inspection or cleaning. During this process, particular care is taken to ensure sanitary conditions.

Traditionally, one of the end covers, commonly referred to as the head, is fixed and the other end cover, commonly referred to as the follower, is moveable towards the head to close the heat exchanger and is movable away from the head to open the heat exchanger.

Heat exchangers of this type are well known and typically include at least two, and more typically, four threaded rods that engage threaded portions of the follower. Rotation of the threaded rods in unison via a drive mechanism causes the follower to evenly open or close depending on the direction of rotation. While this system greatly facilitates the inspection and cleaning process, the threaded rods do introduce a cleaning challenge. That is, the threads can be difficult to fully clean and, if a lubricant is used on the threaded rods, dirt or debris can become trapped in the lubricant and the lubricant itself can be a potential contaminant.

Accordingly, it is desirable to provide a plate heat exchanger that can offer improved performance or efficiency of a follower moved via threaded rods and a drive mechanism without the undesirable task of cleaning the threaded rods.

SUMMARY OF THE INVENTION

The foregoing needs are met, at least in part, by the present invention where, in one embodiment a telescoping cover for a threaded rod in a plate heat exchanger is disclosed.

An embodiment of the present invention provides a plate heat exchanger which includes a head, a housing, a frame, a pack, a follower, and a first tie bar. The housing has a driving mechanism. The frame is disposed between the head and housing. The pack includes a plurality of heat exchange plates. The follower is configured to slide along the frame and compress the pack between the follower and the head. The follower has a nut with internal threads. The first tie bar is disposed between the head and the housing. The first tie bar has external threads configured to mate with the internal threads of the nut. The driving mechanism is configured to rotate the first tie bar and the follower is configured to translate along the first tie bar in response to rotation of the first tie bar. A first telescoping cover is disposed between the head and the follower. The first telescoping cover is configured to cover the first tie bar and control the ingress and egress of fluid coming into contact with the first tie bar disposed within the first telescoping cover.

Another embodiment relates to a device having a first telescoping cover to cover a first portion of a threaded rod and control the ingress and egress of fluid coming into contact with the first portion of the threaded rod disposed within the first telescoping cover.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

In general, embodiments of a telescoping cover described herein are suitable for use with any system that includes a threaded rod where it would be useful to isolate the threaded rod from the rest of the system. For example, as described herein, advantages of the telescoping covers include: providing protection from the surrounding environment to prevent corrosion of the interior parts; prevent exposure of spinning parts to the person operating the machine; facilitate retention of lubrication of the spinning parts by containing lubricants in the cover and prevent lubricants washing off during sanitation cycles; allow movement of the machine with the covers in place which eliminates the need for the covers to be removed when servicing; provides a more sanitary surface than exposed threaded bars; facilitates sealing with single or double O-ring seals; and can be installed on OEM equipment and also retrofit to units in the field. These and other advantages are described herein. More particularly, embodiments of the telescoping cover described herein are suitable for various types of plate heat exchangers that include a threaded rod or threaded tie bar.

Figure 1:
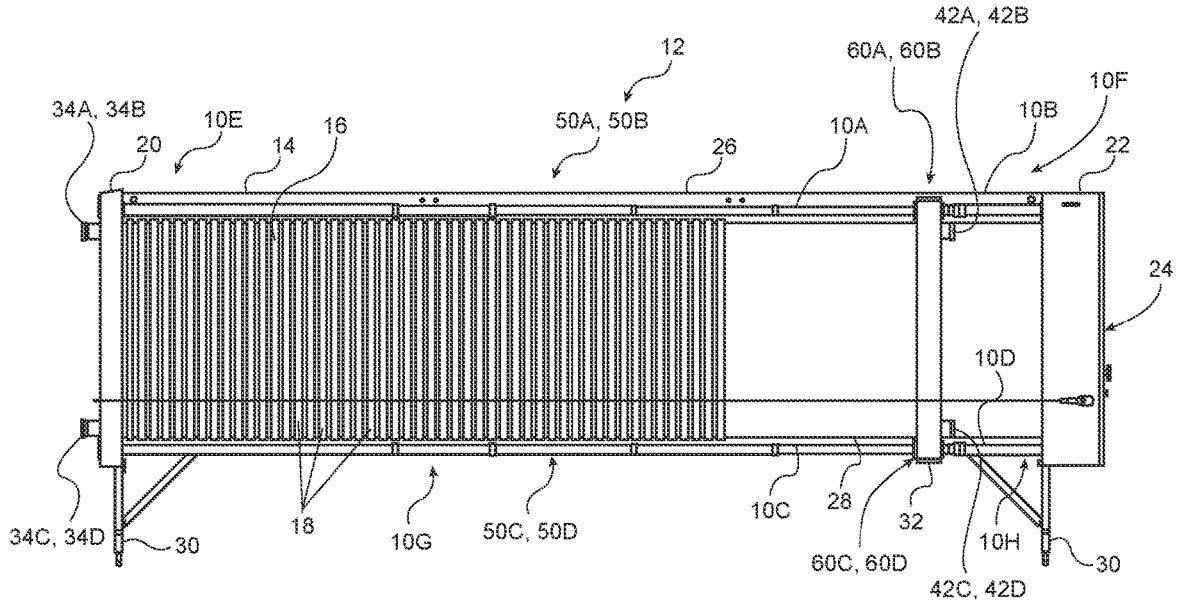
FIG. 1 is a side view of a plurality of telescoping covers disposed on a suitable plate heat exchanger in an open position according to an embodiment of the present invention.
Figure 2:
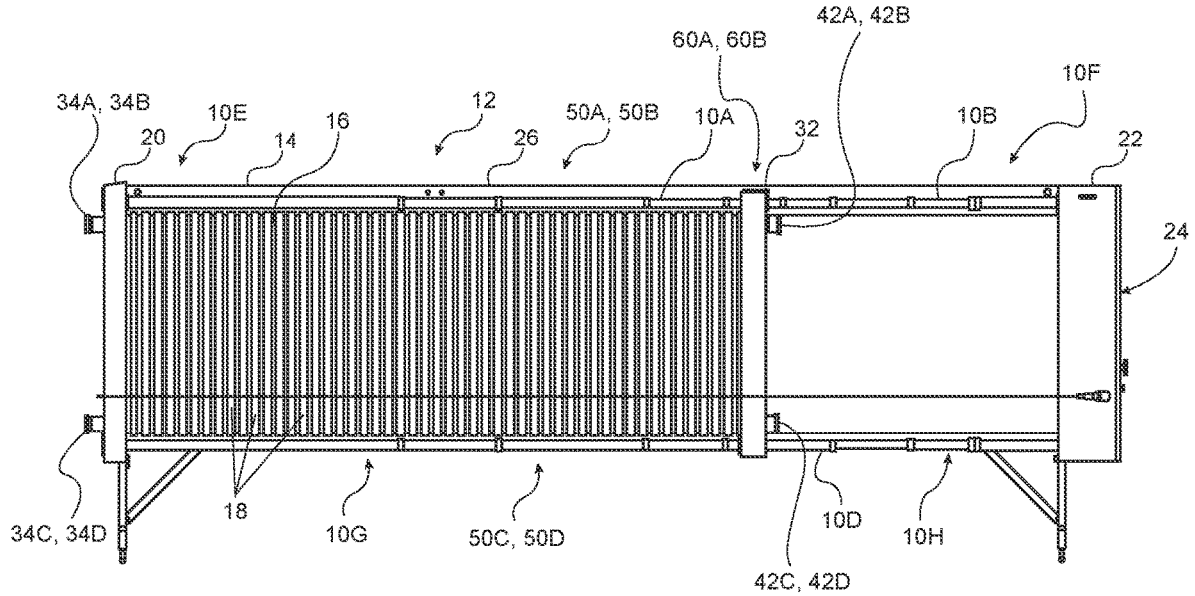
FIG. 2 is a side view of the plate heat exchanger depicted in FIG. 1 in a closed position.
Figure 3:
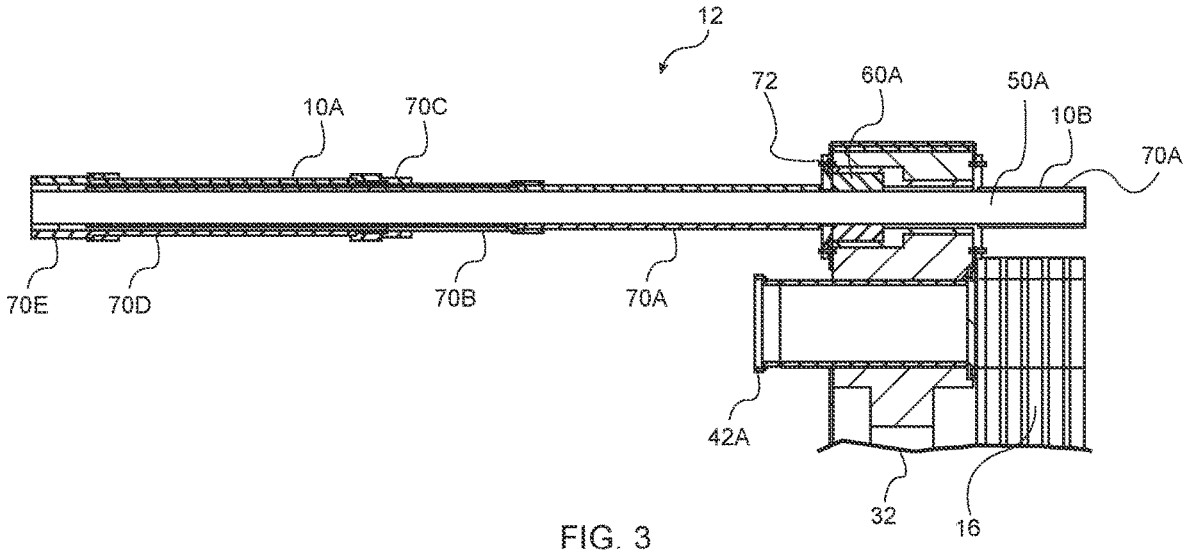
FIG. 3 is a detailed cross-sectional view of the telescoping cover connected to a follower of the plate heat exchanger of FIG. 1.

With reference to FIGS. 1, 2, and 3, a plurality of telescoping covers 10A-10H are shown disposed on a suitable plate heat exchanger 12. In general, a variety of plate heat exchangers are suitable for use with the telescoping covers 10A-10H. In the particular example shown, the plate heat exchanger 12 includes a support frame 14 for a pack 16 of heat transfer plates 18 of metal or other heat conductive material compatible with the fluid(s) to be passed through the plate heat exchanger 12.

The support frame 14 comprises a frame plate or head 20 at one end connected to an enclosure or housing 22 at the other end by spaced parallel upper and lower beams 26, 28. The beams 26, 28 are preferably rigidly affixed to the plate 20 and the enclosure 22. The frame plate 20 and housing 22 are provided with ground engaging feet 30 laterally offset on opposite sides of the frame 14 for added stability. In some examples, the housing 22 optionally includes a driving mechanism 24.

The beams 26, 28 locate and support the pack 16 of heat transfer plates 18 and a pressure plate or follower 32 that is moveable relative to the head 20 to open and close the plate heat exchanger 12 as described later herein.

The plate pack 16 is clamped together between the head 20 and the follower 32 when the plate heat exchanger 12 is closed and sealing gaskets (not shown) between the plates 18 form separate passageways for fluids to flow through the plate heat exchanger 12. The passageways communicate with combinations of four ports 34A to 34D in the head 20 and combinations of four ports 42A to 42D in the follower 32 for fluid to flow into and out of the plate heat exchanger 12. The heat transfer plates may include one or a pair of end plates that do not include fluid on both sides (and, thus, are not technically considered heat transfer plates) but are similarly mounted in the frame 14 and thus form a part of the pack 16. In a generally understood manner, each plate 18 has upper and lower slots that slidably receive the upper and lower beams 26 and 28, respectively. The upper beam 26 has opposed lengthwise extending flanges.

The support frame 14 further includes four threaded rods or tie bars 50A to 50D (collectively referred to herein as "tie bars 50A-50D") extending between the head 20 and the enclosure 22 and shown in FIGS. 1 and 2. As described herein, the tie bars 50A-50D are covered by the telescoping covers 10A-10H and the tie bars 50A-50D are shown disposed within the respective telescoping covers 10A-10H in FIGS. 1 and 2. In a particular example shown herein, each tie bar 50A-50D is covered by a pair of telescoping covers 10A-10H. For example, the tie bar 50A is covered by the telescoping cover 10A disposed between the head 20 and the follower 32 and the tie bar 50A is covered by the telescoping cover 10B disposed between the follower 32 and the housing 22. In this manner, the entire tie bar 50A is covered by the telescoping covers 10A and 10B. One pair of tie bars 50A and 50B are located on opposite sides of the upper beam 26 and may be spaced above the plate pack 16. The other pair of tie bars 50C and 50D are located on opposite sides of the lower beam 28 and may be spaced below the plate pack 16. The tie bars 50A-50D are located outside of the outer peripheries of the heat transfer plates 18. Preferably, the tie bars 50A-50D are positioned adjacent to the shorter edges of the heat transfer plates 18. According to some embodiments, the tie bars 50A-50D are preferably all located above or below the heat transfer plate. Moreover, according to some embodiments, some of the tie bars are located above the heat transfer plates while the remainder of the tie bars are located below the heat transfer plates.

The tie bars 50A-50D bear directly or indirectly at one end against the head 20 and are rotatable relative to the head 20 via friction reducing bearings (not shown). If the housing 22 includes the optional driving mechanism, the tie bars 50A-50D are coupled at their opposite ends to the driving mechanism 24 within the enclosure 22 for rotating the tie bars 50A-50D as is generally understood. Alternatively, the tie bars 50A-50D may be rotated manually.

Each tie bar 50A-50D is externally threaded and extends through the follower 32 and threadedly and loosely engages a respective nut 60A-60D that bears directly or indirectly against the follower 32 on the side remote from the head 20. Each tie bar 50A-50D and its associated nut 60A-60D collectively form a tie bar assembly. Each nut 60A-60D is captured to prevent rotation and axial separation relative to the follower 32. In this way, the nuts 60A-60D move along the tie bars 50A-50D in response to rotation of the tie bars 50A-50D and the follower 32 moves with the nuts 60A-60D. As a result, rotation of the tie bars 50A-50D in one direction causes the follower 32 to move towards the head 20 to close the plate heat exchanger 12 and rotation in the opposite direction causes the follower 32 to move away from the head 20 to open the plate heat exchanger 12. Alternatively, the nuts 60A-60D may be arranged to allow rotation relative to the follower 32 so that rotation of the nuts 60A-60D relative to the follower 32 and the associated tie bar moves the follower 32 toward and away from the head 20.

Various methods of controlling the rotation of the tie bars 50A-50D may be employed and they are not critical to the operation of the telescoping covers 10A-10H. Examples of controlling the rotation of the tie bars 50A-50D and thereby controlling the opening and closing of the plate heat exchanger 12 are shown and described in U.S. Pat. No. 6,899,163, Titled "Plate heat exchanger and method for using the same", the disclosure of which is hereby incorporated in its entirety.

During servicing, inspection, cleaning, and the like, the plate heat exchanger 12 is opened and any fluids within the pack 16 may be released. The telescoping covers 10A-10H are configured to provide protection to the tie bars 50A-50D and reduce or eliminate exposure to the threads of the tie bars 50A-50D. As described herein, a system of seals is configured to control, reduce and/or prevent the ingress of fluids from the outside environment from contacting the tie bars 50A-50D. Another advantage of the telescoping covers 10A-10H is that they are configured to retain lubricants and/or corrosion inhibitors on the tie bars 50A-50D and prevent the removal of the lubricants and/or corrosion inhibitors during sanitizing procedures performed on the plate heat exchanger 12. Furthermore, the telescoping covers 10A-10H are more sanitary and easier to clean that the threaded tie bars 50A-50D. As such, the sanitizing procedures may be performed more quickly and easily which reduces the costs associated with operating the plate heat exchanger 12. Yet another advantage of the telescoping covers 10A-10H is that, while they do telescope to extend and/or contract, they are not configured to rotate. As such, the telescoping covers 10A-10H reduce or prevent entanglement in the rotating tie bars 50A-50D. These and other advantages of the telescoping covers 10A-10H are described herein.

As shown in FIG. 1, the plate heat exchanger 12 is in the open configuration so that the follower 32 is drawn away from the pack 16 and the plates 18 can be serviced. In this open configuration, the telescoping cover 10A is in a relatively extended configuration and the telescoping cover 10B is shown in a relatively contracted configuration. Similarly, the remaining telescoping covers disposed between the follower 32 and the head 20 are in the relatively extended configuration and the remaining covers disposed between the follower 32 and the housing 22 are in the relatively contracted configuration. It is an advantage of the telescoping covers 10A-10H that the entirety of each tie bar 50A-50D are covered and sealed from any ingress of fluids from the pack 16 and sanitizing fluids and the entirety of each tie bar 50A-50D are covered and sealed from any egress of lubricating fluids.

As shown in FIG. 2, the plate heat exchanger 12 is in an operational or closed configuration so that the follower 32 is bearing upon the pack 16 so that the plates 18 and gaskets (not shown) form a seal to facilitate the flow of coolant and product. In this closed configuration, the telescoping cover 10A is in a relatively contracted configuration and the telescoping cover 10B is shown in a relatively extended configuration. Similarly, the remaining telescoping covers disposed between the follower 32 and the head 20 are in the relatively contracted configuration and the remaining covers disposed between the follower 32 and the housing 22 are in the relatively extended configuration. Again, in each configuration, it is an advantage of the telescoping covers 10A-10H that the entirety of each tie bar 50A-50D are covered and sealed from any ingress of fluids from the pack 16 and sanitizing fluids and the entirety of each tie bar 50A-50D are covered and sealed from any egress of lubricating fluids.

Figure 4:
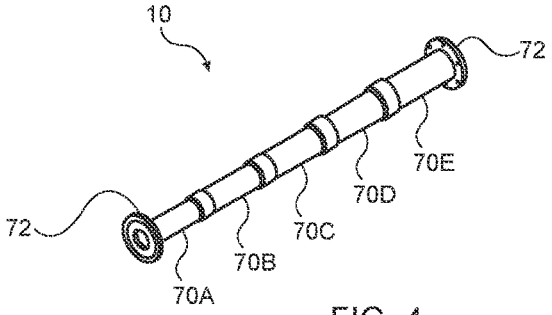
FIG. 4 is an orthogonal view of the telescoping cover of FIG. 1.

FIG. 3 is a detailed cross-sectional view of the telescoping covers 10A and 10B connected to the follower 32 of the plate heat exchanger 12 and covering the tie bar 50A. As shown in FIG. 3, the telescoping covers 10A and 10B each include a plurality of segments 70A-7011 (shown in more detail in FIG. 5). One end of each of the telescoping covers 10A and 10B is shown secured to the follower 32 via a respective seal plate 72. With reference to FIGS. 1, 2, and 4, the other ends of the telescoping covers 10A and 10B are secured to the head 20 and housing 22, respectively, with respective seal plates 72. Of note, the seal plate 72 facilitates capturing the nut 60A in the follower 32 so that the follower 32 is translated along the tie bar 50A in response to rotation of the tie bar 50A.

Figure 5:
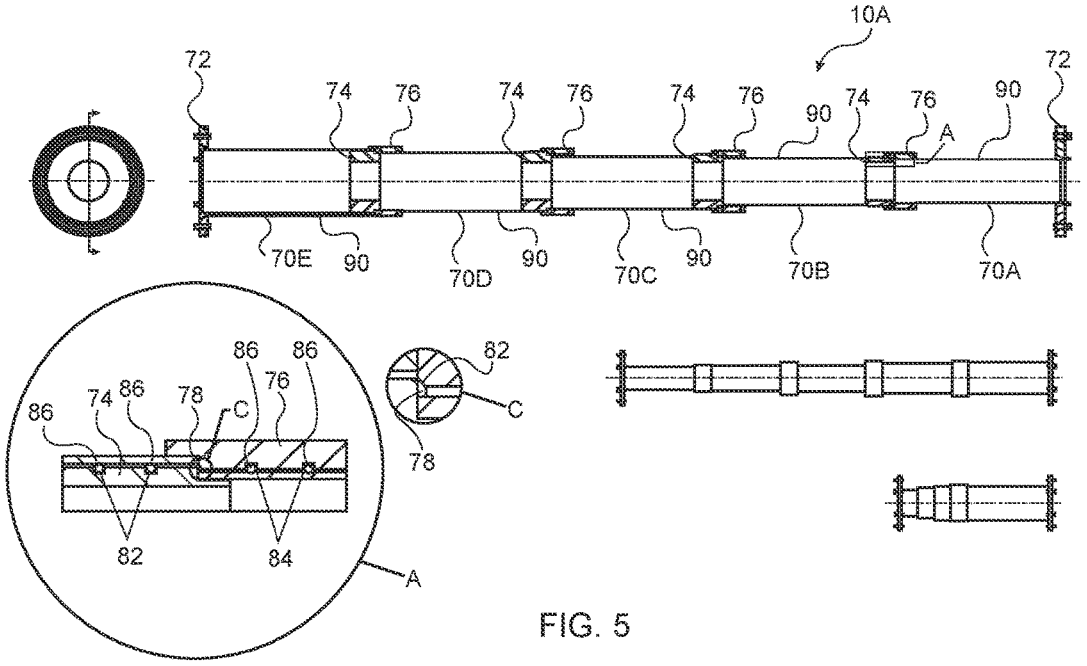
FIG. 5 is a cross-sectional view of the telescoping cover of FIG. 1 and detailed views of a ferrule assembly for the telescoping cover.

The plurality of segments 70A-70*r*1 are configured to slide or telescope one within the next as shown most clearly in FIG. 5. The ends of the segments 70A-70*r*1 that are configured to slide within an adjacent segment 70A-70*n* include a respective interior ferrule 74. The ends of the segments 70A-70*r*1 that are configured to receive an adjacent segment 70A-70*r*1 include a respective exterior ferrule 76. The interior ferrules 74 and exterior ferrules 76 may be affixed to the respective segments 70A-70*r*1 in any suitable manner. Examples of suitable methods for affixing the interior ferrules 74 and exterior ferrules 76 to the segments 70A-70*r*1 include welding, brazing, gluing, press fitting, threading, and the like. In a particular example, the interior ferrules 74 and exterior ferrules 76 are affixed to the respective segments 70A-70*r*1 by welding to reduce crevices that may present a sanitation challenge.

FIG. 4 is an orthogonal view of the telescoping cover 10A of FIG. 1. As shown in FIG. 4, the telescoping cover 10A includes five segments 70A-70E. However, in other examples, the telescoping cover 10A may have any suitable number of segments 70A-70*r*1. Examples of suitable number of segments 70A-70*r*1 include two or more. In general, if the telescoping cover 10A has fewer segments 70A-70*r*1 it will have a reduced number of components and sliding seals in comparison to the telescoping cover 10A with an increased number of the segments 70A-70*r*1. However, increasing the number of segments 70A-70*r*1 will increase the range of travel the follower 32 can move between the head 20 and the housing 22.

Also shown in FIG. 4, the segments 70A and 70E each include a respective seal plate 72. As shown in FIG. 4 and cross-sectional view A-A of FIG. 5, each of the segments 70A-70D include an interior ferrule 74 and each of the segments 70B-70E include an exterior ferrule 76. As shown in details A and C, the interior ferrules 74 include a stop surface 78 and one or more O-ring seats 80. The exterior ferrules 76 include a stop surface 82 and one or more O-ring seats 84. The stop surfaces 78 and 82 may be annular and disposed at respective angles to bear upon one another. In operation, the stop surfaces 78 and 82 are configured to bear upon one another and prevent the interior ferrule 74 from sliding past the exterior ferrule 76.

The O-ring seats 80 and 84 are configured to receive respective O-rings 86 and generate a sliding fluid-impermeable seal between the inside and the outside of the telescoping cover 10A. In this manner, the sliding seals within the telescoping covers 10A-10H are configured to control, prevent, or reduce the ingress and egress of fluid into and out of the telescoping covers 10A-10H. With respect to the term, "control of the ingress and egress of fluid into and out of the telescoping covers 10A-10H", as the follower 32 is controlled to translate along the tie bars 50A-50D, air inside the telescoping covers 10A-10H may be compressed and decompressed. In general, the compression and decompression may be balanced because as the telescoping covers 10A-10H between the head 20 and follower 32 are compressed, the telescoping covers 10A-10H between the follower 32 and the housing 22 are decompressed by the same amount. To the extent there may be a pressure imbalance between the inside and outside of the telescoping covers 10A-10H, air may be controlled to enter/exit via the head 20 and/or housing 22.

Also in FIG. 5, the telescoping cover 10A is shown in an extended configuration, e.g., at a maximum length, and a compressed configuration, e.g., at a minimum length. Together, the interior ferrule 74, exterior ferrule 76, and O-rings 86 form a ferrule assembly 88. Also shown in FIG. 5, the segments 70A to 70E each include a respective tube or body 90.

Figure 6:
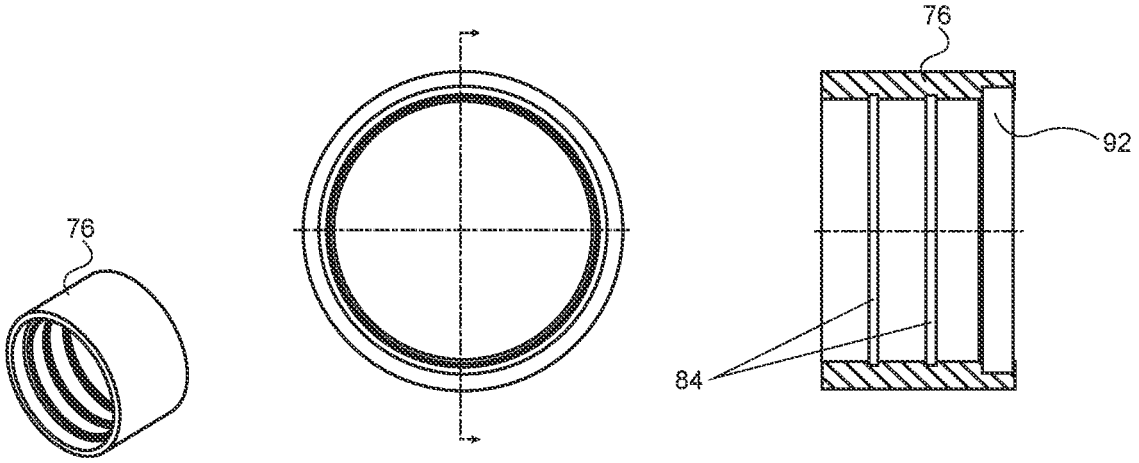
FIG. 6 is a series of detailed views of an exterior ferrule for the ferrule assembly.
Figure 7:
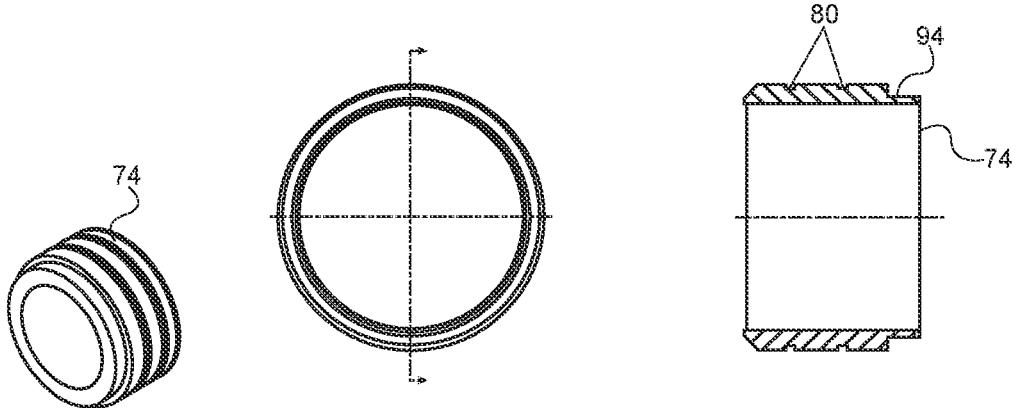
FIG. 7 is a series of detailed views of an interior ferrule for the ferrule assembly.

FIG. 6 is a series of detailed views of the exterior ferrule 76 for the ferrule assembly 88. As shown in FIG. 6, the exterior ferrule 76 includes the O-ring seats 84 and an annular rabbet or seat 92 for the body 90. Similarly, FIG. 7 shows a series of detailed views of the interior ferrule 74 for the ferrule assembly 88 and the interior ferrule 74 includes the O-ring seats 82 and an annular rabbet or seat 94 for the body 90.

Figure 8:
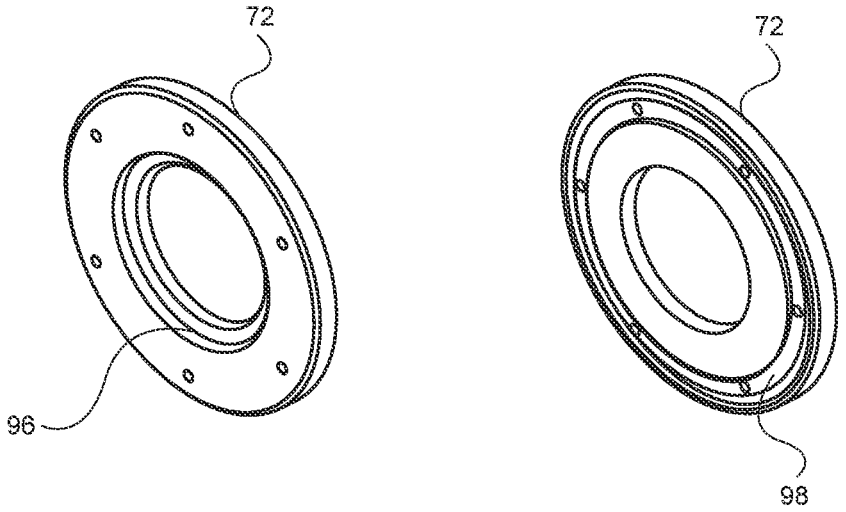
FIG. 8 are orthogonal views of a tie bar seal for the telescoping cover of FIG. 1.

FIG. 8 are orthogonal views of the tie bar seal plate 72 for the telescoping cover 70A-70*n* of FIG. 1. As shown in FIG. 8, the seal plate 72 includes an annular rabbet or seat 96 to receive the body 90 of the first or last segment 70A-70*n* of the telescoping cover 10A-10H. The seat 96 is disposed on an exterior surface and may be affixed to the body 90 in any suitable manner such as, for example, welded, press fit, or the like.

On an interior surface of the seal plate 72, an O-ring seat 98 is disposed annularly about a perimeter and configured to receive an O-ring to seal the seal plate 72 upon the follower 32 (as shown in FIG. 3), the head 20, or the housing 22. In addition, the seal plate 72 includes a series of through bores for bolting the seal plate 72 upon the head 20, the housing 22, or the follower 32.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A plate heat exchanger comprising:

a head;

a housing having a driving mechanism;

a frame disposed between the head and housing;

a pack of heat exchange plates;

a follower configured to slide along the frame and compress the pack between the follower and the head, the follower having a nut, the nut having internal threads;

a first tie bar disposed between the head and the housing, the first tie bar having external threads configured to mate with the internal threads of the nut, the driving mechanism being configured to rotate the first tie bar, wherein the follower is configured to translate along the first tie bar in response to rotation of the first tie bar; and a first telescoping cover disposed between the head and the follower, the first telescoping cover covering the first tie bar, sealing the first tie bar from the outside environment, and controlling the ingress and egress of fluid coming into contact with the first tie bar disposed within the first telescoping cover.

2. The plate heat exchanger according to claim 1, further comprising a second telescoping cover disposed between the follower and the housing, the second telescoping cover being configured to cover the tie bar and control the ingress and egress of fluid coming into contact with the tie bar disposed within the second telescoping cover.

3. The plate heat exchanger according to claim 2, further comprising a second tie bar.

4. The plate heat exchanger according to claim 3, further including a third and fourth telescoping cover to cover the second tie bar, the third telescoping cover disposed between the head and the follower, the fourth telescoping cover disposed between the follower and the housing.

5. The plate heat exchanger according to claim 1, wherein the first telescoping cover further comprises a first end, a second end, and a plurality of segments, each segment including a body.

6. The plate heat exchanger according to claim 5, further comprising a pair of seal plates, wherein a first seal plate of the pair of seal plates is affixed to the first end and a second seal plate of the pair of seal plates is affixed to the second end.

7. The plate heat exchanger according to claim 5, further comprising a ferrule assembly disposed between each pair of adjacent segments of the plurality of segments and the ferrule assembly being configured to provide a sliding seal to facilitate one segment of the pair of segments sliding into the other segment of the pair of segments.

8. The plate heat exchanger according to claim 7, wherein the ferrule assembly further comprises an inner ferrule and an outer ferrule, the inner ferrule being affixed to an end of a respective segment of the plurality of segments and configured to slide within an inner surface of the body of an adjacent segment of the plurality of segments, the outer ferrule being affixed to an end of a respective segment of the plurality of segments and configured to slide along an outer surface of the body of an adjacent segment of the plurality of segments.

9. The plate heat exchanger according to claim 8, wherein the inner ferrule further comprises an inner stop surface and the outer ferrule further comprises an outer stop surface, the inner stop surface and the outer stop surface being configured to bear upon one another and prevent the withdraw of the inner ferrule from the outer ferrule.

10. A plate heat exchanger comprising a head;

a housing having a driving mechanism;

a frame disposed between the head and housing;

a pack of heat exchange plates;

a follower configured to slide along the frame and compress the pack between the follower and the head, the follower having a nut, the nut having internal threads;

a first tie bar disposed between the head and the housing, the first tie bar having external threads configured to mate with the internal threads of the nut, the driving mechanism being configured to rotate the first tie bar, wherein the follower is configured to translate along the first tie bar in response to rotation of the first tie bar;

a first telescoping cover disposed between the head and the follower, the first telescoping cover being configured to cover the first tie bar and control the ingress and egress of fluid coming into contact with the first tie bar disposed within the first telescoping cover; and a ferrule assembly disposed between each pair of adjacent segments of the plurality of segments and the ferrule assembly being configured to provide a sliding seal to facilitate one segment of the pair of segments sliding into the other segment of the pair of segments, the first telescoping cover comprising a first end, a second end, and a plurality of segments, each segment including a body, the ferrule assembly further comprising an inner ferrule, an outer ferrule, and an O-ring seat disposed in one or both of the inner ferrule and outer ferrule and a corresponding O-ring disposed in the O-ring seat, the inner ferrule being affixed to an end of a respective segment of the plurality of segments and configured to slide within an inner surface of the body of an adjacent segment of the plurality of segments, the outer ferrule being affixed to an end of a respective segment of the plurality of segments and configured to slide along an outer surface of the body of an adjacent segment of the plurality of segments.

11. The plate heat exchanger according to claim 1, wherein the first telescoping cover comprises a seal for sealing the first tie bar from the outside environment.

12. The plate heat exchanger according to claim 4, wherein each of the first, second, third and fourth telescoping covers comprises a system of seals is configured to control, reduce and/or prevent the ingress of fluids from the outside environment.

* * * * *